US005106110A

United States Patent [19]

Williamson

[11] Patent Number: 5,106,110

[45] Date of Patent: Apr. 21, 1992

[54] UNICYCLE ROLLER SKATE

[76] Inventor: Lawrence J. Williamson, 15254 Promenade, Detroit, Mich. 48224

[21] Appl. No.: 663,675

[22] Filed: Mar. 4, 1991

[51] Int. Cl.[5] ..... A63C 17/08; A63C 17/14

[52] U.S. Cl. ..... 280/11.2; 280/11.24; 280/11.27; 188/72.9; D21/226

[58] Field of Search ..... 280/11.2, 11.24, 11.36, 280/87.041, 11.25, 11.27; 188/24.12, 24.15, 24.16, 72.9; D21/226

[56] References Cited

U.S. PATENT DOCUMENTS

| | | | |
|---|---|---|---|
| 182,835 | 10/1876 | Lockwood | 280/11.2 |
| 853,447 | 5/1907 | French | 280/11.23 X |
| 1,176,074 | 3/1916 | Malcolm | 280/11.2 |
| 1,517,352 | 12/1924 | Foote | 280/11.2 |
| 1,628,004 | 5/1927 | Stetson | 280/11.15 |
| 3,330,571 | 7/1967 | Pierce | 280/11.24 |
| 4,051,924 | 10/1977 | Yoshigai | 188/24.12 |
| 4,108,451 | 8/1978 | Scheck | 280/11.24 |
| 4,194,751 | 3/1980 | Shinmura | 280/11.2 |
| 4,379,564 | 4/1983 | Welker | 280/11.2 |
| 4,805,936 | 2/1989 | Krantz | 280/11.2 X |
| 4,943,075 | 7/1990 | Gates | 280/11.2 X |

FOREIGN PATENT DOCUMENTS

| | | | |
|---|---|---|---|
| 598429 | 5/1960 | Canada | 280/11.24 |
| 9334 | 4/1880 | Switzerland | 280/11.24 |
| 12596 | 6/1896 | Switzerland | 280/11.27 |
| 48239 | 11/1909 | Switzerland | 280/11.24 |
| 863453 | 9/1981 | U.S.S.R. | 188/24.15 |
| 15148 | 7/1896 | United Kingdom | 280/11.24 |
| 1686 | 1/1897 | United Kingdom | 280/11.24 |

*Primary Examiner*—Andres Kashnikow
*Assistant Examiner*—Brian L. Johnson
*Attorney, Agent, or Firm*—Dykema Gossett

[57] ABSTRACT

A unicycle roller skate comprises a fork frame including a top plate and a plurality of angularly related opposed pairs of wheel mount arms at their upper ends secured to front, rear and central portions of the top plate. The arms converge downwardly and upon their opposite sides terminate in a pair of slotted axle supports. A tire on a iron and having a hub journaled upon an axle is interposed between the pairs of arms with the axle nested within the slotted supports and secured thereto. A caliper brake depends from the top plate and includes friction pads spaced from opposite sides of the rim. A flexible cable at one end adjustably depends from a handle and at its other end operatively engages the brake caliper. A pivotal brake actuator upon the handle is connected to the cable for selectively applying tension thereto.

3 Claims, 2 Drawing Sheets

UNICYCLE ROLLER SKATE

FIELD OF INVENTION

The present invention relates to roller skates and more particularly to a roller skate with one wheel.

BACKGROUND OF THE INVENTION

Previously hand held and similar locomotion devices have been disclosed for separate mounting upon the feet of a user usually with some form of handle or other support in addition to a wheel support and with some provided with remote controlled braking devices. Examples of such deices are set forth in one or more of the following United States Patents:

| U.S. Pat. No. | Date | Title |
|---|---|---|
| 1,176,074 | March 21, 1916 | Means for Locomotion |
| 1,628,004 | May 10, 1927 | Skating Device |
| 3,330,571 | July 11, 1967 | One Wheeled Skate |
| 4,108,451 | August 22, 1978 | Roller Skates with Hand Brakes |
| 4,194,751 | March 25, 1980 | Rolling Type Athletic Apparatus |
| 4,805,936 | February 21, 1989 | Wheeled Ski |

SUMMARY OF THE INVENTION

An important feature of the present invention is to provide a unicycle roller skate which comprises a fork frame of inverted U shape including a top plate and a plurality of elongated angularly related opposed pairs of wheel mount arms at their upper ends underlying and secured to spaced front, rear and central portions of the top plate respectively and converging downwardly and upon their opposite sides terminating in a pair of spaced axle supports. The tire on a rim having a hub journaled upon an axle is interposed between said fork and said axle nested and secured upon said slotted supports and secured thereto.

Another feature is to provide for the unicycle roller skate a manual brake controlled from a remote location for stopping or slowing down the forward movement of one or a pair of such roller skates upon the shoes of a user.

Another feature includes a brake means which depends from the top plate centrally thereof, overlies the single wheel and includes one or a pair of pivot arms mounting friction pads normally in spaced registry with the rim together with a flexible cable having a pair of ends. One end of the cable is connected to the pivot arms of the brake and the other end is connected to a separate hand held handle for supporting the cable and including a manually operable brake actuator for each such handle. The actuator is operably connected to the cable for selectively applying tension thereto for activating the brake and applying friction to said rim.

As another feature longitudinally spaced pairs of opposed inwardly directed slots are formed in said top plate adjacent its opposite ends adapted to receive a pair of adjustable straps threaded therethrough adapted to retaining engaged portions of the users shoe.

As another feature a boot is secured to the top plate for receiving the users foot.

As another feature the brake means includes a pivot mount post which depends centrally from the top plate intermediate its ends overlying the tire and includes a pair of pivot arms mounting brake pads adapted to engage opposite sides of the wheel rim when tension is applied to the cable.

As another feature the brake means includes a caliper brake assembly which is suspended from central under surface portions of the top plate and operated by an elongated cable. One end of the cable is connected to the caliper brake and the other end is connected to a handle carried in the hand of the user for applying braking action as desired by the user.

Still another feature of the present invention includes a rider propelled vehicle adapted to be operated by a rider in a standing position comprising a pair of unicycle roller skates and wherein each skate includes a top plate together with a plurality of angularly related opposed pairs of wheel mount arms at their upper ends secured to the top plate with their lower converging ends terminating in a slotted axle support. A tire on a rim and having a hub journaled upon an axle is interposed between the pairs of wheel mount arms with the axle nested and secured upon the slotted supports. A brake assembly is mounted upon and depends from each of the top plates. A flexible cable has a pair of ends with one end being connected to the brake assembly and with the other end connected to a handle held in the hand to support the other end of the cable and wherein a manually operable brake actuator is connected to one end of the cable adapted to apply tension thereto for selectively applying the brakes to the respective unicycle roller skates upon the feet of the user.

These and other features and objects will be seen from the following specification and claims in conjunction with the appended drawings.

THE DRAWINGS

It will be understood that the above drawings illustrate merely a preferred embodiment of the invention, and that other embodiments are contemplated within the scope of the claims hereafter set forth.

DETAILED DESCRIPTION OF AN EMBODIMENT OF THE INVENTION

Figure 1:
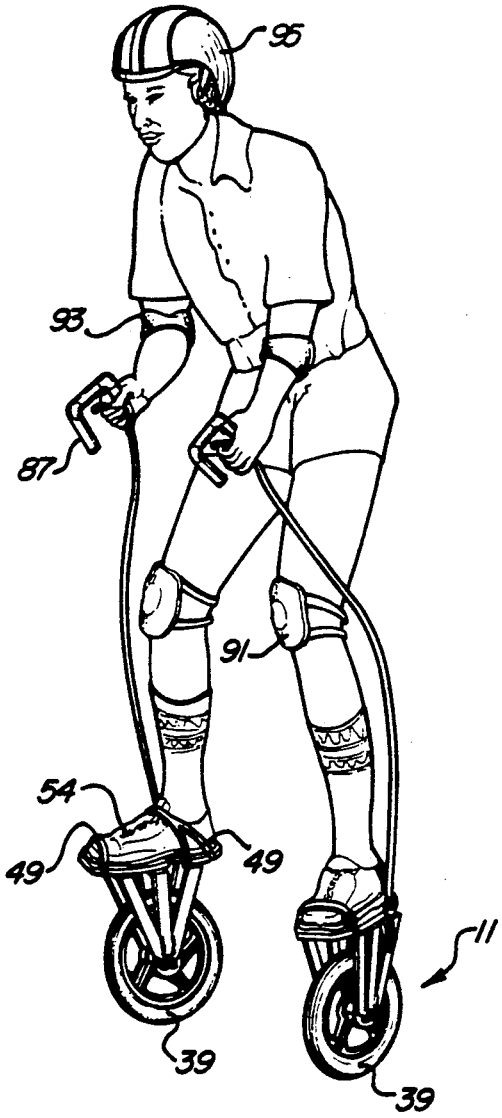
FIG. 1 is a front perspective view of a pair of the present unicycle roller skates with the shoes of the user strapped thereto.
Figure 2:
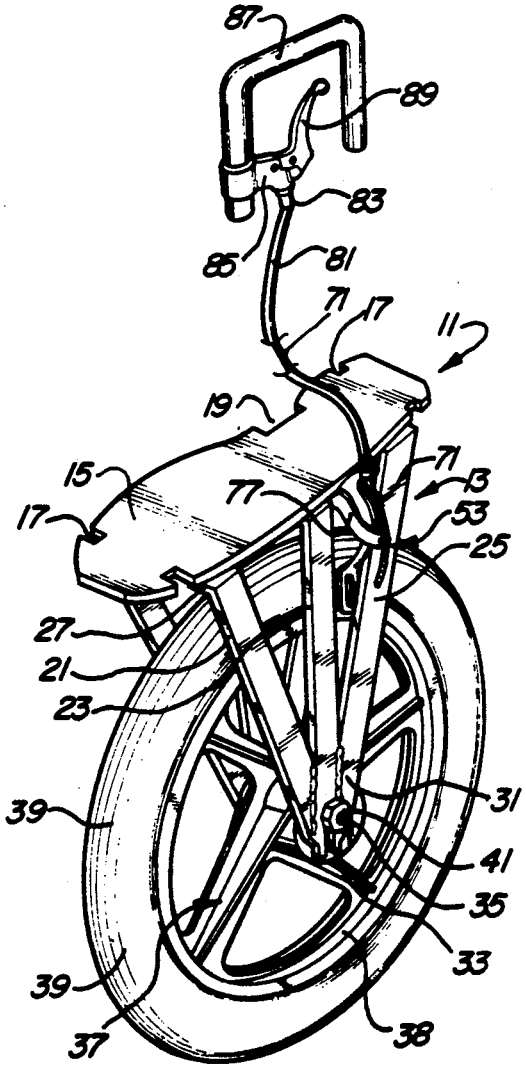
FIG. 2 is a front perspective view of the unicycle roller skate of FIG. 1, on an increased scale and with the cable partly broken away.

Referring to the drawings, the present unicycle roller skate is generally indicated at 11, FIGS. 1 and 2 and includes a fork frame 13 of general inverted U shape. The fork frame includes top plate 15 having longitudinally spaced pairs of opposed inwardly directed slots 17 and 19 formed therein adapted to receive the respective fastener straps 49 and 50, FIGS. 1 and 3.

The present fork frame 13 further includes a plurality of elongated angularly related opposed pairs of wheel mount arms 21, 23 and 25, FIG. 2. Each of these arms at its upper end has an inwardly directed top flange 27 which bears against the under surface of top plate 15 and is secured thereto as by the weld 29. The respective top flanges 27 engage under surface portions of top plate 15 at spaced front, rear and central portions thereof, in FIGS. 2 and 3.

The respective arms on opposite sides of the fork frame 13 converge together downwardly and upon opposite sides terminate in the unit axle supports 31 including downwardly opening slots 33.

A rubber tire 39, preferably an inflatable tire, includes the rim 38 and the supporting wheel 37 together with an apertured hub 47. Said hub is journaled upon transverse axle 35 which is projected into and retained within the slots 33 of the axle supports 31 and suitably secured thereto. Said securing includes the internal threaded fasteners 43, washers 45 and the external fasteners 41 and corresponding washer on the outside of the respective axle supports 31, FIGS. 2 and 4.

By this construction the present wheel 37 with inflated tire 39 is nested within the fork frame 13 between the respective proposed pairs of converging arms 21, 23 and 25 as the solitary support for the top plate 15 in a unit construction.

Figure 3:
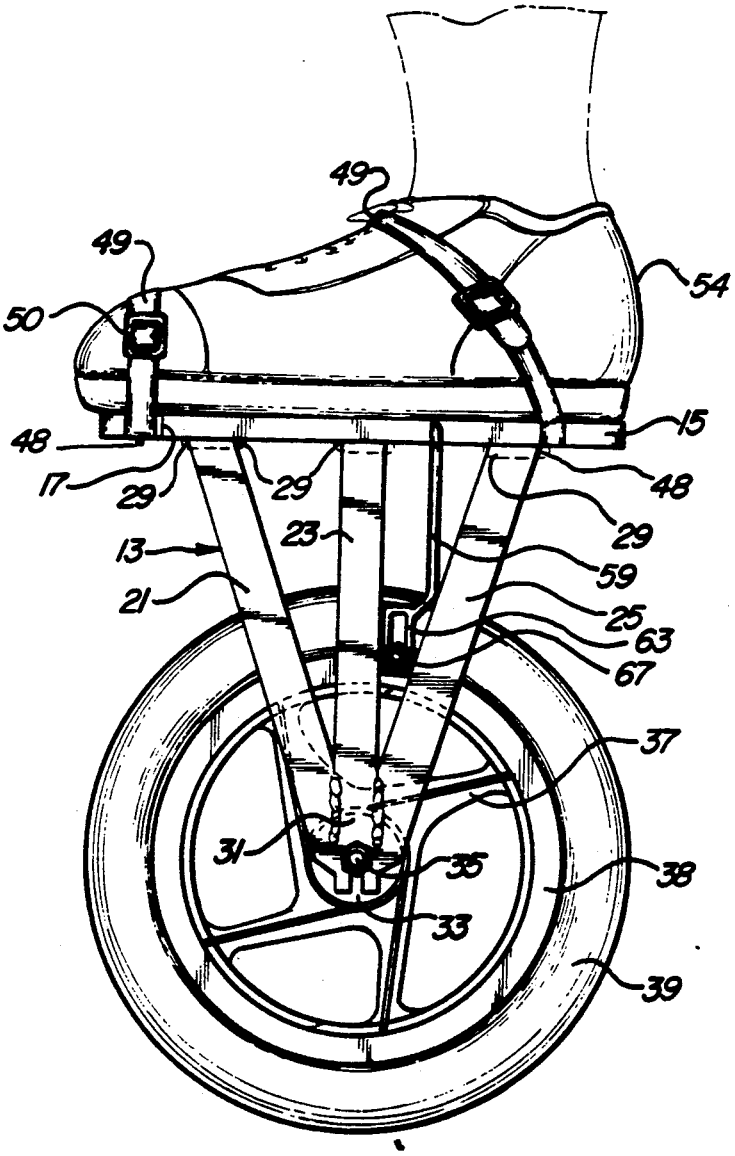
FIG. 3 is a side elevational view of the unicycle roller skate shown in FIG. 1, on an increased scale corresponding to FIG. 2 and illustrating the straps anchoring the users shoe thereon.

In the illustrative embodiment, FIGS. 1 and 3, the user's shoes are positioned over the respective top plate 15 and retained thereon by the pair of straps 49 which are threaded through the respective opposed slots 17 and 19 and adjustably secured as by the fasteners 50 in a conventional manner.

The respective straps intermediate their ends are anchored to under surface portions of top plate 15 as by the rivets or other fasteners 48, FIG. 3.

Figure 5:
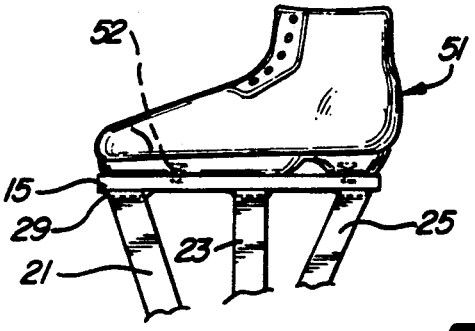
FIG. 5 is a fragmentary side view similar to FIG. 3 illustrating a permanent boot applied to the top plate of the unicycle roller skate.

In a modified construction, and replacing the shoe 54 there is shown fragmentarily in FIG. 5 a boot 51 which overlies the top plate 15 and is secured thereto by a plurality of rivets or other fasteners 52. This construction represents a simplification or improvement because it avoids the use of straps. The boots are merely laced onto the user's feet and the unicycle roller skate is ready for immediate use. The function and operation is exactly the same whether the shoes 54 are strapped in place, FIGS. 1 and 3 or the boot 51 is used in FIG. 5.

A manual brake controlled from a remote location is provided for use of the operator as shown in the drawings and particularly FIGS. 1 and 2. There is provided a conventional brake caliper 53 supported upon the under surface of top plate 15 and including a pair of conventional pivot arms 55 and 57 pivotally connected together at 59 to the depending pivot mount 61. Said pivot mount depends from a central portion of top plate 15 intermediate its ends and centrally thereof so as to overlie tire 39.

Figure 4:
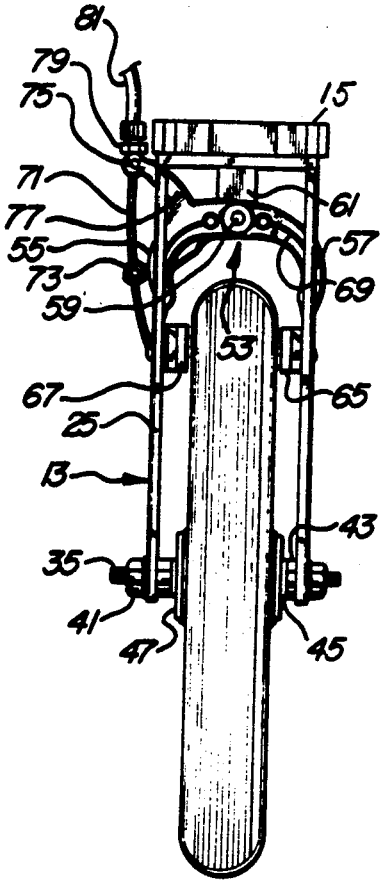
FIG. 4 is a fragmentary end elevational view thereof.

The respective pivot arms 55 and 57 at their lower ends terminate in a slotted portion 63, FIG. 3, in order to mount the opposed friction pads 65 adjustably secured in position by fastener 67. Said pads are in opposing registry with respect to rim 38 on opposite sides thereof. As shown in FIG. 4, a pair of leaf springs 69 normally bias the respective arms 55 and 57 outwardly of the rim 38 upon its opposite sides to a normal brake release position.

The present manual brake is under the control of a pull cable 71 which is secured at one end or its lower end by connector 73 to one of the arms 55. The cable extends loosely through a sleeve connection 75 upon one end of the cantilever 77 which extends from an intermediate portion of the other pivotal brake arm 57, in a conventional manner and adjacent the adjustable stop nut 79, FIG. 4.

In the illustrative embodiment there is provided an elongated protective sheath 81 which encloses the cable 71 at its lower end from which the cable projects as in FIG. 4. The upper end of the sheath extends to the cable mount 85 which is secured upon the handle 87 of U shape. The brake actuator 89 is pivotally connected to mount 85. Manual pressure upon the actuator 89 effects a shortening of the cable 71 such as to apply tension to cable 71 and to activate the brake arms 55 and 57 into pivotal movement in opposite directions with respect to the pivot point 59 for application of the brake pads 65 with respect to the rim 38 for slowing down or stopping the unicycle roller skate.

For each of the respective unicycle roller skates there is applied a separate handle 87 and a separate brake actuator 89 so that in the operation of the present unicycle roller skate in pairs one on each shoe or boot as in FIG. 2, the operator has his hands upon the respective handles 87 and the respective brake actuators 89. Thus the brakes can be uniformly applied with the desired pressure sufficient to slow down the unicycle roller skates respectively and to bring them to a stop as desired or to control downward speed such as when moving down an incline surface.

In the operation of the present unicycle roller skate wherein a pair is employed, FIG. 1, the user as a precautionary measure employs padded knee pads 91, elbow pads 93 and a protective helmet 95.

Having described my invention, reference should now be had to the following claims.

I claim:

1. A unicycle roller skate comprising a fork frame of inverted U shape including a top plate to support a user's shoe and having opposite ends and an underside and a plurality of elongated angularly related opposed pairs of wheel mount arms, the upper ends of said arms having an inturned flange underlying and welded to spaced front, rear and central portions of said top plate respectively and converging downwardly and said arms upon opposite sides being connected together and terminating in a pair of spaced slotted axle supports;

a tire on a rim having a hub journaled upon an axle interposed between said pairs of wheel mount arms with the axle nested and secured within said slotted supports;

a brake means mounted upon and depending from said undersurface of said top plate having at least one normally retracted pivot arm mounting a friction pad in registry with said rim;

a flexible cable having a pair of ends, one end being connected to said arm;

a handle supporting the other end of said cable; and a manually operable brake actuator upon said handle and operatively connected to said cable for selectively applying tension to said cable to apply said friction pad to said rim.

2. In the unicycle roller skate of claim 1, further comprising a pivot mount post depending centrally from said top plate intermediate said ends, said brake means including a brake caliper having a pair of opposed arms pivotally mounted upon said post;

each arm mounting a friction pad; and a sheath surrounding said cable having upper and lower ends, at said upper end connected to said handle, and at said lower end arranged adjacent said brake caliper.

3. A rider-propelled vehicle adapted to be operated by a rider in a standing position and comprising a pair of unicycle roller skates;

each skate comprising a fork frame of inverted U shape including a top plate to support a user's shoe and having opposite ends and a plurality of elongated angularly related opposed pairs of mount arms, the upper ends of said arms having an inturned flange underlying and secured to spaced front, rear and central portions of said top plate respectively and converging downwardly and said arms upon opposite sides being connected together and terminating in a pair of spaced slotted axle supports;

a tire on a rim having a hub journaled upon an axle interposed between said pairs of wheel mount arms with the axle nested and secured within said slotted supports;

a brake means mounted upon and depending from an underside of said top plate having at least one normally retracted pivot arm mounting a friction pad in registry with said rim;

a flexible cable having a pair of ends, one end being connected to said arm;

a handle supporting the other end of said cable; and a manually operable brake actuator upon said handle and operatively connected to said cable for selectively applying tension to said cable to apply said friction pad to said rim.

* * * * *